US005934026A

United States Patent [19]

Green

[11] Patent Number: 5,934,026

[45] Date of Patent: Aug. 10, 1999

[54] MOBILE HOME

[76] Inventor: Blake Green, 1023 Coolidge, Wichita, Kans. 67203

[21] Appl. No.: 09/049,615

[22] Filed: Mar. 27, 1998

[51] Int. Cl.[6] ..... E04B 1/34; E04H 1/00

[52] U.S. Cl. ..... 52/143; 52/79.5; 52/67; 52/126.5; 296/25; 296/26.01

[58] Field of Search ..... 52/79.5, 67, 143, 52/126.5; 296/25, 26.01

[56] References Cited

U.S. PATENT DOCUMENTS

| | | | |
|---|---|---|---|
| 3,490,173 | 1/1970 | Clemens | 52/67 |
| 4,202,146 | 5/1980 | Adams | 52/143 X |
| 4,348,843 | 9/1982 | Cairns et al. | 52/143 X |
| 4,891,919 | 1/1990 | Palibroda | 52/79.5 |
| 4,958,874 | 9/1990 | Hegedus | 52/79.5 X |
| 5,168,675 | 12/1992 | Shea, Sr. | 52/67 X |
| 5,237,784 | 8/1993 | Ros | 52/79.5 |
| 5,657,589 | 8/1997 | De Bood | 52/126.5 X |
| 5,706,616 | 1/1998 | Fernandez | 52/79.5 X |
| 5,765,316 | 6/1998 | Kavarsky | 52/79.5 X |

*Primary Examiner*—Carl D. Friedman
*Assistant Examiner*—Brian E. Glessner
*Attorney, Agent, or Firm*—Kenneth H. Jack

[57] ABSTRACT

A road transportable home consisting of a floor having a drop floor aperture therethrough; a drop floor, the drop floor being fitted so that it may underlie the drop floor aperture; and a series of slide shafts and slide sleeves capable of movably attaching the drop floor to the floor so that the drop floor may travel between a first position and a second position, the first position having an elevation below that of the floor, the second position having an elevation above that of the first position, the slide shafts and slide sleeves interconnecting the drop floor and the floor.

20 Claims, 5 Drawing Sheets

MOBILE HOME

FIELD OF THE INVENTION

The invention described and portrayed hereinbelow relates to road transportable homes and road transportable double wide home sections commonly known respectively as mobile homes and double wide mobile home sections. More particularly this invention relates to such road transportable homes and double wide home sections having apparatus and features applied thereto allowing them to be alternately configured, its configurations including a first configuration suitable for road or highway transportation, and a second configuration that, while unsuitable for road transportation, has enhanced living space.

BACKGROUND OF THE INVENTION

A typical road transportable home, commonly known as a mobile home, is constructed upon a pair of steel longitudinally extending "I" beams which serve as its major structural support members; such "I" beams typically having a 12 inch web and 2 inch upper and lower flanges. The pair of steel longitudinally extending "I" beams typically support a multiplicity of floor joists which extend perpendicularly across the upper flanges of the "I" beams, and which are preferably spaced 16 inches apart along the full length of the mobile home. Such floor joists are typically composed of 2 inch by 8 inch pine stock planks. The house structure of such typical mobile home extends upward from the upper surfaces of its floor joists; the structure being similar to those of common immobile wooden frame houses.

In order to transport a typical mobile home, such as is described above, upon a road, a wheel carriage is temporarily bolted to the steel "I" beams; such wheel carriage typically raising the entire mobile home structure to an elevation wherein the lower flanges of the "I" beams are approximately 16 inches above the road.

Passage of the mobile home beneath bridges often is necessary. The interior height of a typical bridge over a U.S. interstate highway is 16 feet 4 inches. Subtracting the vertical dimensions of the 8 inch floor joists, the 12 inch "I" beams, and the 18 inch road clearance referred to above from a standard 16 foot 4 inch bridge height leaves 13 feet 2 inches as an absolute maximum height of a mobile home house structure which may be erected upon the upper surfaces of its floor joists. In order to be assured of safe clearance when transported beneath interstate bridges, a mobile home is typically constructed so that its structure extends upward from the upper surface of its floor joists no more than 12 feet 7 inches. Such vertical structural space, while being ample for a single story structure, is insufficient for a 2 story split level structure. In the event such 12 foot 7 inch vertical space were utilized for constructing upper and lower split level rooms, a portion of the vertical space would necessarily be dedicated to the vertical dimensions of the roof and of the second floor; leaving less than 6 feet for the interior vertical dimensions of the first and second floor rooms. As a practical matter, an upper floor and a lower floor cannot be situated within a vertical space of 12 feet 7 inches.

A typical mobile home has 4 foot high crawl space beneath its floor joists, such crawl space resulting from mounting of the one foot tall steel "I" beams upon the upper surfaces of piers which typically rise 3 feet above the ground. The instant inventive mobile home utilizes such crawl space by providing a floor section which is alternately downwardly extendable and upwardly retractable; such section allowing, through downward extension, utilization of the vertical dimension of the crawl space as living space, and allowing, through upward retraction, mounting of the mobile home upon a wheel carriage for road transportation.

PRIOR ART

"Side out" camper trailer are known. A typical "side out" camper trailer has a side wall section which is extendable laterally from a major side wall of the camper; and has moveable walls, roof and floor which are extendable laterally with the side wall section.

"High-low" camper trailers are known. A typical "high-low" camper trailer has four lower side walls which nest within four upper side walls, the upper ends of the upper side walls supporting the camper's roof. In operation of a "high-low" camper the upper side walls and roof may be alternately positioned at a lowered position for purposes of highway travel and at an upper position for enhanced vertical space for purposes of camping use.

Mobile homes having an upwardly extendable roof are known. Such mobile homes commonly include a positionable roof, such roof having a lowered position for facilitating passage under bridges in highway travel, and such roof having a raised position for enhancing interior living space.

None of the above described configurations of campers or mobile homes, each disclose or describe the novel inventive, useful, and unique aspects, elements and features of the present inventive mobile home.

SUMMARY OF THE INVENTION

A preferred embodiment of the instant inventive road transportable home, commonly known as a mobile home, comprises a forward main floor section, a rearward main floor section, and a drop floor section situated between the forward and rearward main floor sections. A first pair and a second pair of parallel "I" beams preferably provide the main structural support for the forward and rearward main floor sections, such "I" beams preferably being situated along the extreme left and right sides of the main floor sections. Secondary structural support of the forward and rearward main floor sections comprises a multiplicity of 2 inch by 8 inch floor joists spaced approximately 18 inches apart and spanning perpendicularly between the left and right "I" beams. The primary structural support of the drop floor section preferably comprises a pair of 6 inch by 8 inch angle irons, such angle irons preferably being situated and positioned along the extreme left and right sides of the drop floor section. Secondary structural support of the drop floor section preferably comprises a series of 2 inch by 6 inch floor joists spaced approximately 16 inches apart and extending perpendicularly between the angle irons.

The forward main floor section and the rearward main floor section preferably comprise a rigid unitary structure provided by a third pair of "I" beams which span between and interconnect the "I" beams of the forward and rearward main floor sections. Preferably the "I" beams among the third pair of "I" beams each overlap the outwardly facing surfaces of the "I" beams supporting the forward and rearward main floor sections; the overlap providing a rectangular drop floor aperture having a width approximately equal to the widths of the forward and rearward main floor sections. Preferably, the drop floor section is rectangular and is fitted to match the dimensions of and to underlie the drop floor aperture.

The drop floor is preferably slidably mounted upon the rigid unitary structure which comprises the forward and rearward main floor sections, so that the drop floor may be selectively and alternately slidably moved from a first position wherein the lower surface of the drop floor lies at an elevation approximately 3½ feet below the lower surface of the main floor, to a second position wherein the upper surface of the drop floor lies at an elevation approximately equal to the elevation of the lower surfaces of the forward and rearward main floor sections. Slidable motion of the drop floor section between its first and second positions is preferably facilitated by a series of slide sleeves which are fitted for slidably receiving a series of slide shafts, the slide sleeves being fixedly attached to and extending upwardly from the inwardly facing surfaces of the third pair of "I" beams; and the slide shafts being fixedly attached to and extending vertically upward from the inwardly facing surfaces of the vertical flanges of the angle iron supports of the drop floor. Through the use of sheer pin joints extending through the slide sleeves and through the slide shafts, the drop floor may be selectively affixed in either its first position or its second position. Preferably the slide sleeves and slide shafts are fabricated from square tubing, the interior bores of the slide sleeves being fitted for slidably receiving the slide shafts.

When the drop floor of the present inventive mobile home is upwardly slidably moved and affixed in its second position, and when a removable wheel carriage is attached to the undersurface of its rearward floor section, the lower surface of the drop floor preferably lies at an elevation substantially above the wheel axles of the wheel carriage, such elevation allowing the mobile home to be pulled as a trailer upon a road or highway. In configuring the mobile home for residential use, the wheel carriage is removed, the mobile home is placed upon a series of 3 foot tall concrete piers, which are spaced and positioned to underlie the lower flanges of the "I" beams of the forward and rearward floor sections. Between the forward and rearward main floor sections a series of 6 inch high concrete piers are poured, the 6 inch concrete piers being positioned to underlie the angle iron supports of the drop floor. Upon placement of the mobile home upon such piers the drop floor is slidably downwardly moved so that the lower surfaces of its angle irons rest upon the upper surfaces of the 6 inch concrete piers. Through such downward extension of the drop floor an additional 3½ feet of vertical interior space is obtained, allowing construction of a second floor.

The floor of the second or upper floor of the present inventive mobile home preferably comprises a series of 2 inch by 8 inch floor joists which span between the side walls of the mobile home, the floor joists preferably being spaced approximately 16 inches apart. Preferably the floor joists of the second floor are positioned so that their undersurfaces lie approximately 7 feet above the upper surface of the drop floor, leaving approximately 7 to 8 feet of interior head room for the upper floor.

Preferably access between the main floor and the drop floor is provided by a stair which is fixedly attached to the upper surface of the drop floor and which extends upwardly therefrom to an elevation equal to the elevation of the upper surface of the main floor. Alternately, where it is desirable to avoid dedicating floor space of the drop floor to a stairway, the stair may, after placement of the mobile home upon piers, be constructed to extend downward from the upper surface of the main floor to an outside edge. In an alternate embodiment of the instant invention, a drop floor and main floor configuration substantially identical to that described above is applied to a double wide mobile home. In such configuration paired drop floors are preferably aligned with respect to each other in the paired double wide half sections providing a wider overall drop floor room.

Accordingly it is an object of the present invention to provide single wide or double wide road transportable home or mobile home, such home having a drop floor facilitating utilization of vertical space within the house's crawl space and allowing construction within such home of a first and a second floor.

Other and further objects, benefits, and advantages of the present invention will become known to those skilled in the art upon review of the detailed description which follows, and upon review of the appended drawings.

DETAILED DESCRIPTION OF THE PREFERRED EMBODIMENT

Figure 5:
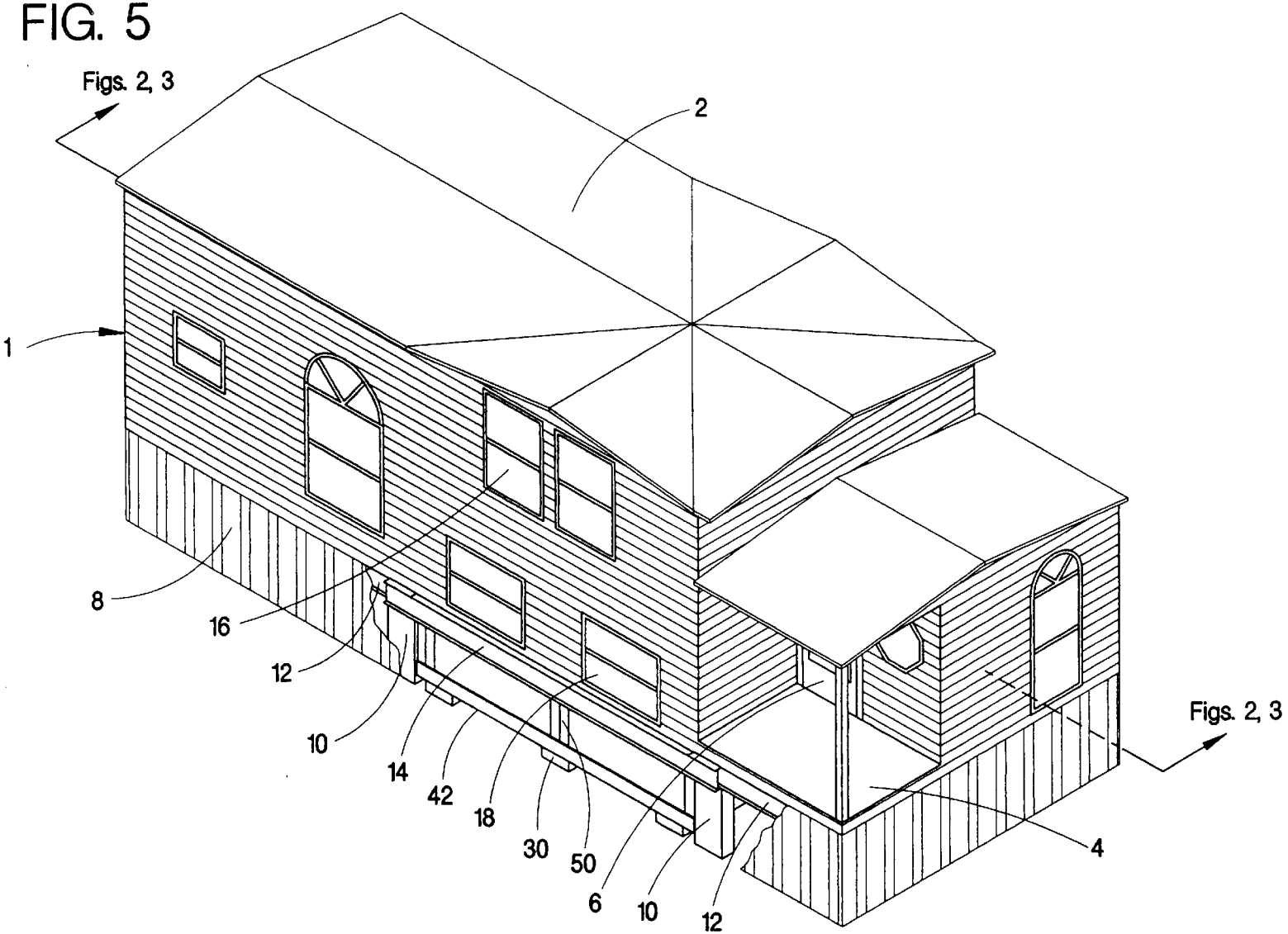
FIG. 5 is an isometric view of the road transportable mobile home, the view including a cut away of side skirting.

Referring now to the drawings, and in particular the drawing FIG. 5, a preferred embodiment of a "single-wide" road transportable home or mobile home is designated generally by drawing element 1. The mobile home 1 has a shallow sloped roof 2, and a front porch landing 4 leading to a front door 6; the front door landing 4 being accessible by a stair (not shown) extending upward from ground level. The mobile home 1 has a skirting 8 approximately four feet in height. The mobile home 1 preferably is mounted upon a series of concrete piers 10 each of which are approximately three feet in height, the piers 10 being positioned around the periphery of the mobile home 1 so that its structural "I" beam supports 12 rest upon the upper surfaces of the piers 10.

Referring further FIG. 5 the mobile home 1 preferably has a plurality of windows including a first pair of windows 16 and a second pair of windows 18, such windows preferably being arranged to indicate to an outside viewer that the mobile home 1 has interior upper and lower split level rooms.

Figure 3:
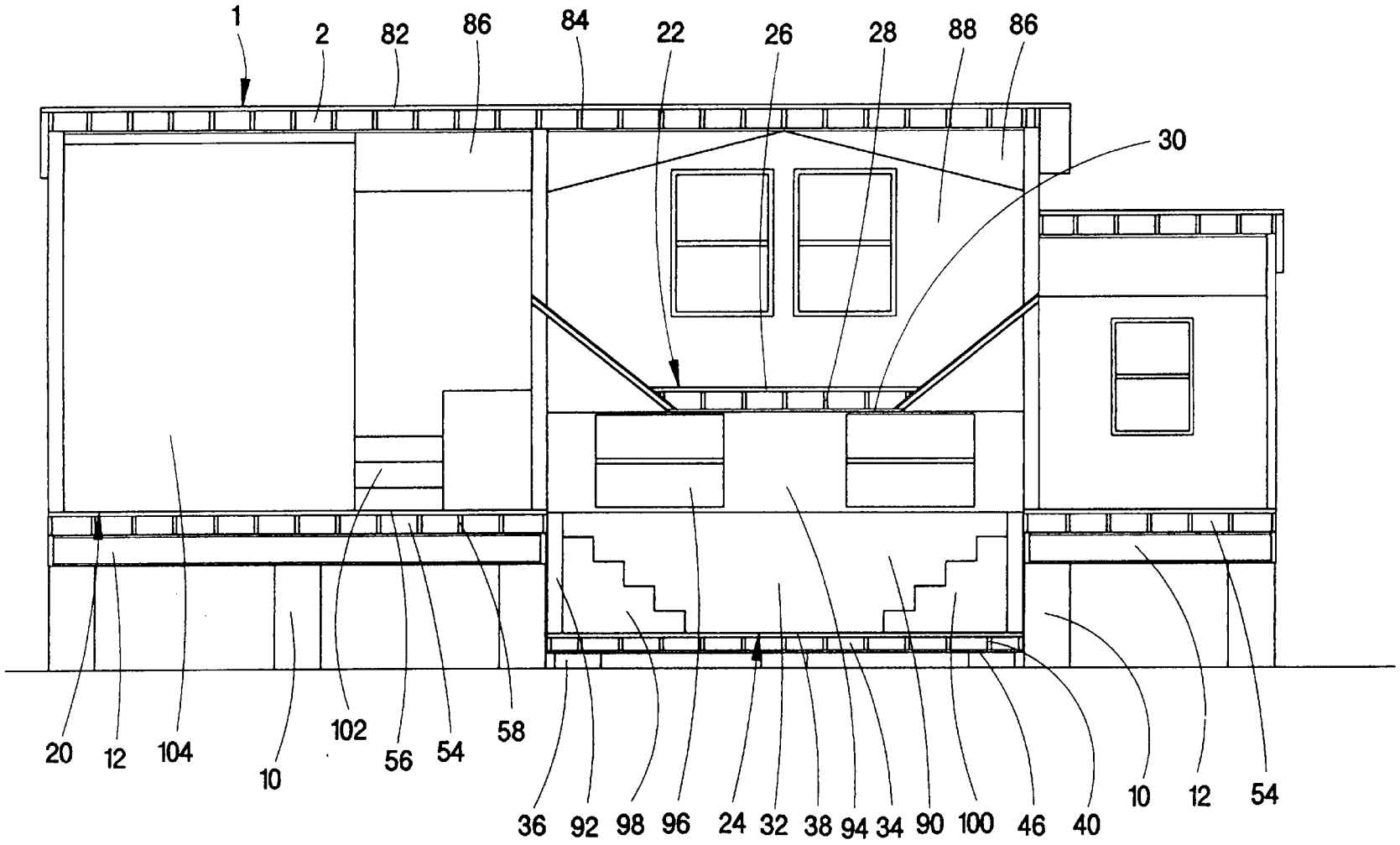
FIG. 3 is an alternate side sectional view of the road transportable home.
Figure 4:
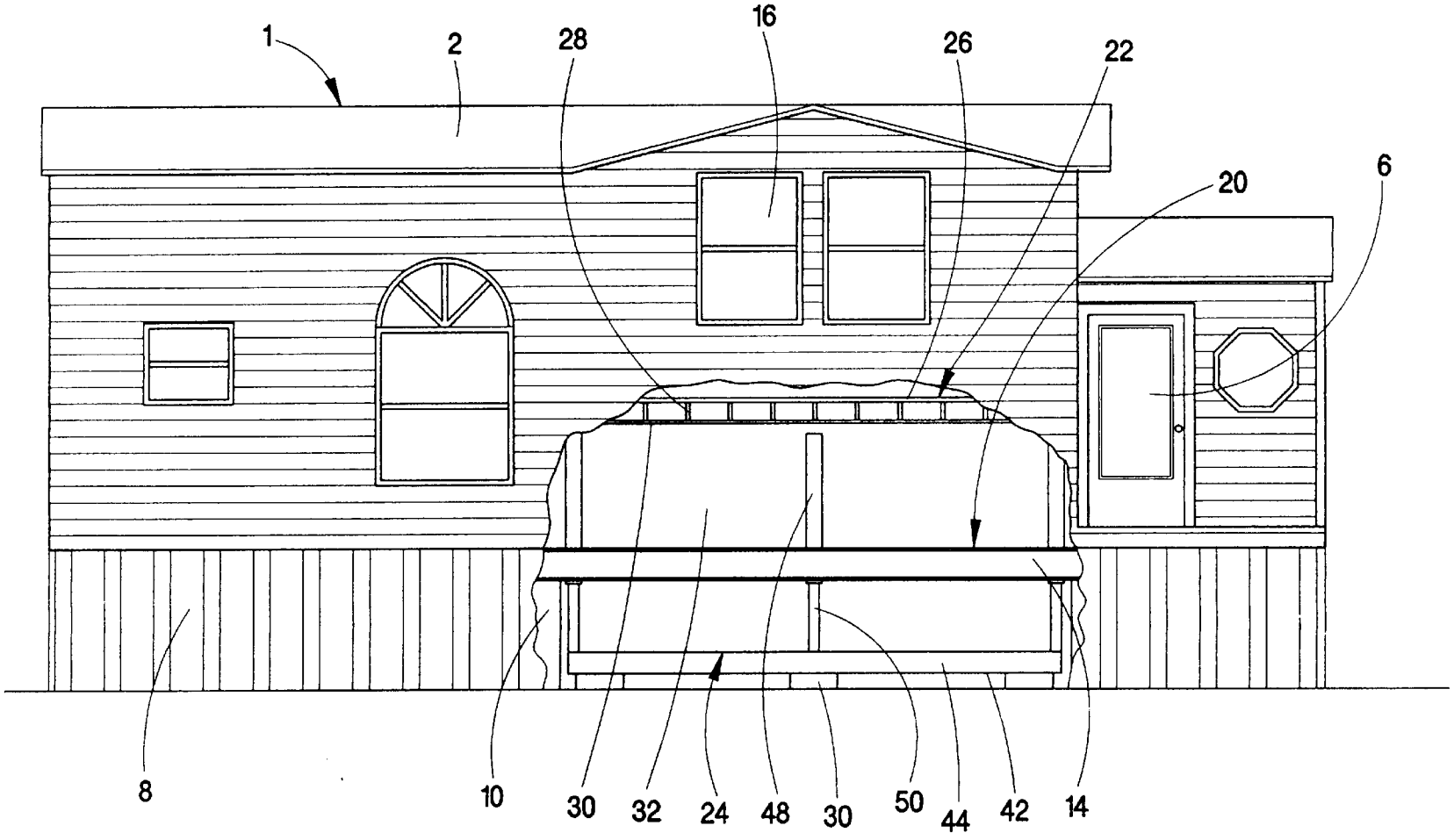
FIG. 4 is a side view of the road transportable mobile home, the view including a cut away of outer siding and skirting.

Referring simultaneously to FIGS. 3 and 4 the mobile home 1 has three floor levels, a main floor level designated by arrow 20, an upper level designated by arrow 22, and a drop floor level designated by arrow 24. The upper level 22 preferably comprises a layer of composite board 26 supported by a series of two inch by eight inch floor joists 28, the under surface of the floor joists 28 being covered by a layer of sheet rock 30 forming a ceiling for a lower split level room 32.

Figure 2:
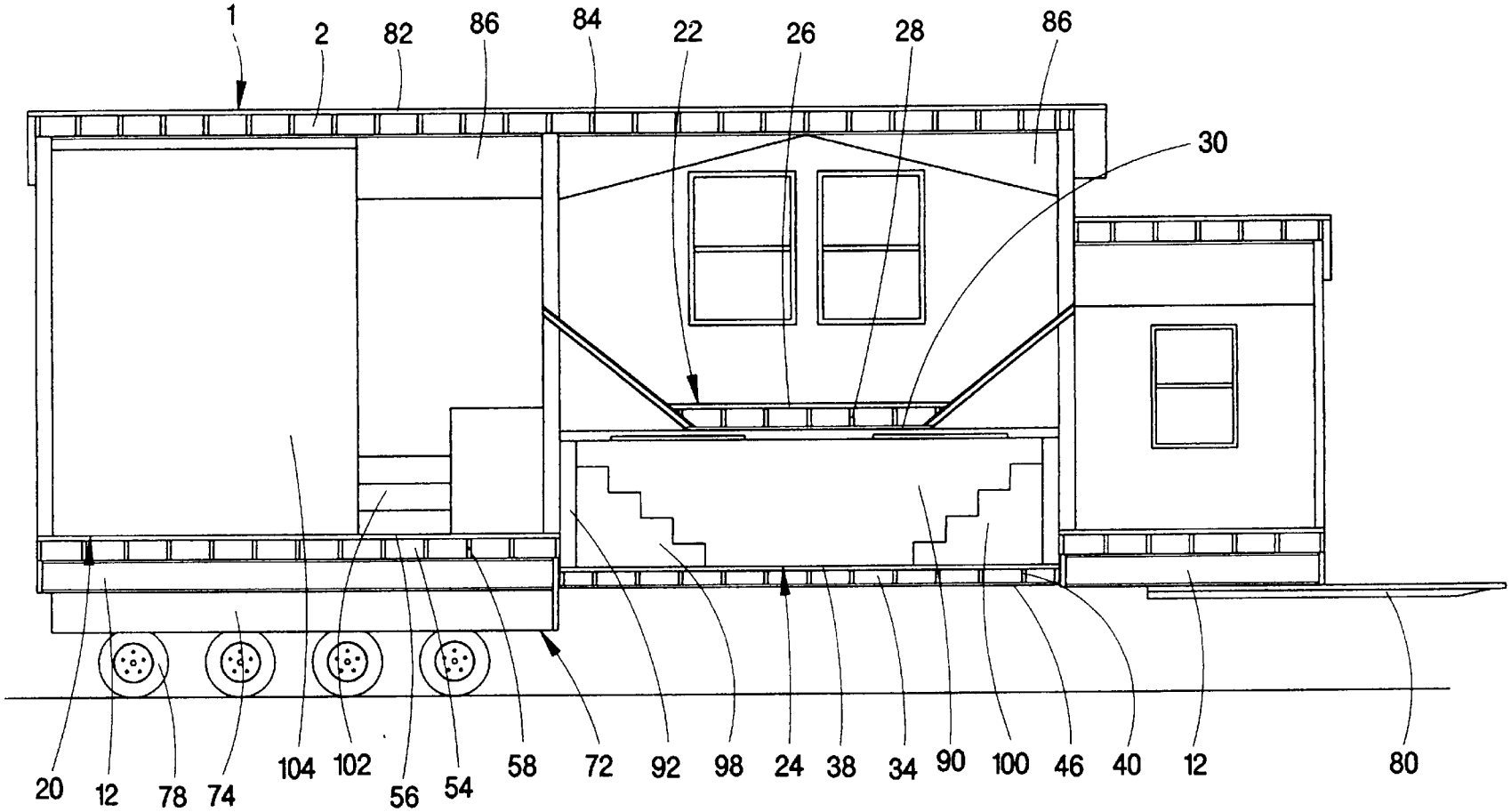
FIG. 2 is a side sectional view of the road transportable home.

Referring further to FIG. 4, as can be seen from the perspective of the view, there is insufficient vertical distance between the main floor level 20 and the ceiling 30 to provide a living space for the lower split level room 32. Referring simultaneously to FIGS. 2 and 4, in order to provide sufficient living space within the lower split level room 32, the drop floor 34 is extendable downward from the lower surface of the "I" beam 14 to rest upon the upper surfaces of a series of six inch tall piers 36. Referring to FIG. 2 the drop floor 34 preferably comprises the layer of composite board 38 which is supported by a series of two inch by six inch floor joists 40. Referring simultaneously to FIGS. 2 and 4 the left and right edges of the drop floor 34 are preferably supported by a pair of six inch by eight inch angle irons 42, the angle irons 42 having vertically extending flanges 44 and horizontally extending flanges 46. Preferably the ends of the floor joists 40 rest within and are supported by the interior surfaces of the "L" of the angle irons 42. Referring simultaneously to FIGS. 2 and 4, downward telescoping motion of the drop floor 34 is provided by a drop floor mounting means preferably comprising series of six slide sleeves 48, the slide sleeves 48 being welded to the inwardly facing surfaces of "I" beams 14. The slide sleeves 48 are preferably fabricated from square structural tubing and are fitted for slidably receiving a series of six slide shafts 50 which are also preferably fabricated from square tubing. Slide shafts 50 are preferably welded to the inwardly facing surfaces of the vertical flanges 44 of the angle irons 42. Both the slide sleeves 48 and the slide shafts 50 are situated so that they lie within the insulation space of the side walls of the lower split level room 32.

Figure 1:
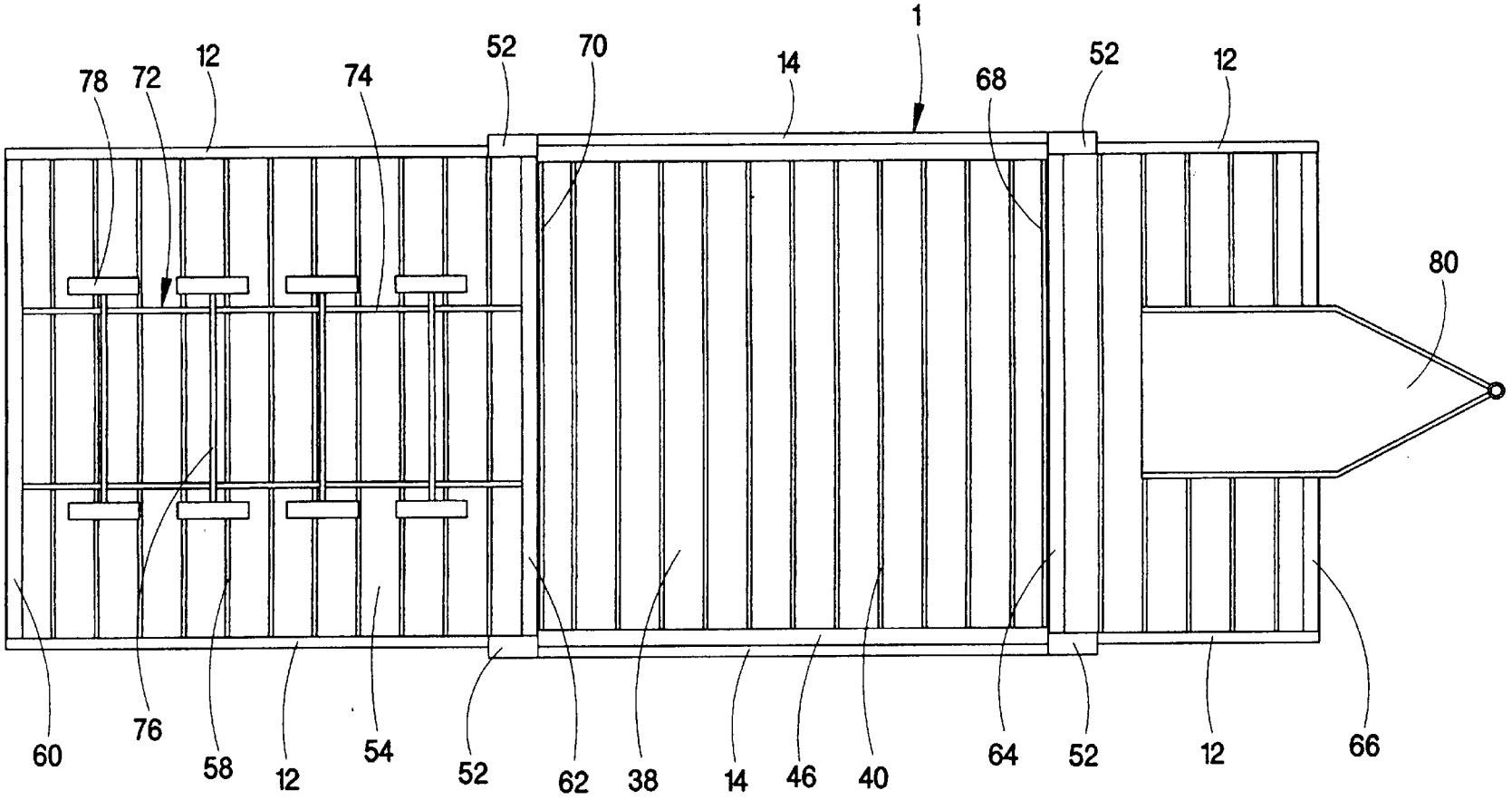
FIG. 1 is a plan view of the undersurface of the road transportable home.

Referring to FIG. 1, depicting the under surface of the mobile home 1, "I" beams 14 which extend along the left and right sides of the drop floor 34 overlap and are welded to "I" beams 12 at overlap joints 52. By overlapping "I" beams 14 and "I" beams 12, rather than utilizing a continuous "I" beam along the full length of the mobile home 1, the lateral dimension of the drop floor 34 may be substantially equal to the lateral dimension of the main floor 54. The main floor 54 is preferably composed of an upper layer of composite board 56 which overlies a series of two inch by eight inch floor joists 58. Preferably the "I" beams 12 and 14 have a twelve inch web and have two inch upper and lower flanges. Also preferably the lower surfaces of the floor joists 58 rest upon and are affixed by lag screws to the upper surfaces of such "I" beam flanges. Preferably, steel cross beams 60, 62, 64, 66 provide structural rigidity to the mobile home floor in addition to that provided by the floor joists 58. The steel cross beams 62 and 64 in combination with "I" beams 14 define a square or rectangular drop floor aperture, providing a steel frame for such aperture Similarly, angle irons 42 in combination with a forward 68 and a rearward 70 drop floor floor joist provide a structural drop floor frame.

Referring simultaneously to FIGS. 1 and 2, the mobile home 1 may be configured to for road transportation by bolting to its under surface a wheel carriage 72, the wheel carriage preferably comprising a pair of steel beams 74 which span between and interconnect steel cross beams 60 and 62. Preferably a series of four axles 76 are fixedly attached to the lower surfaces of the steel beams 74, the ends of the axles 76 having rotatably mounted thereon eight wheels 78. A removable trailer hitch tongue 80 is similarly temporarily bolted to the forward under surface of the mobile home 1 facilitating pulling the mobile home 1 by a towing vehicle along a road or highway. Referring simultaneously to FIGS. 2 and 3, the wheel carriage 72 and the trailer hitch tongue 80 are removed when the mobile home 1 is configured for residential use.

Referring to FIG. 3, the roof 2 preferably comprises an upper layer of shingle covered composite board 82 which is supported by a series of two inch by eight inch ceiling rafters 84. Preferably, layers of sheetrock 86 are applied directly to the lower surfaces of the rafters 84, eliminating an attic space and enhancing vertical living space with in the upper split level room 88.

Referring further to FIG. 3, wainscot height walls 90 are preferably fixedly attached to and extend upward from the composite board surface 38 of the drop floor 34. Preferably the walls 90 comprise two inch by four inch wall studs 92 which are covered by an interior layer of finished sheetrock. Upon lowering the drop floor 34 from its, referring simultaneously to FIG. 2 and 3, upper road transport position, the upper surfaces of the studs 92 and the sheetrock wall 90 are preferably covered by finished woodwork and molding trim, eliminating any gap between the walls 94, the lower split level room windows 96, and the wall 90.

Referring further to FIG. 3, stairs 98 and 100 preferably are fixedly attached to the upper surface of the composite board floor 38 of the drop floor 34, the stairs 98 and 100 providing a walkway between the main floor 54 and the lower split level room 32. Similarly, stairs 102 are fixedly attached to the upper surface of the composite board floor 56 of the main floor 54, the stairs 102 providing access between the upper split level room 88 and the main floor living room 104. In an alternate configuration (not shown), where it is desirable that stair 98 not occupy floor space within the lower split level room 32, the stair 98 may be rearwardly located so that it downwardly extends from the composite board floor surface 56 of the living room 104 to meet the rearward edge of the drop floor 34. Where such drop floor space saving configuration is utilized it is preferable that the stair 98 be constructed in place after road transportation is completed and upon configuration of the mobile home for residential living use.

The drop floor configuration described above for application to single wide mobile homes is equally applicable to road transportable home sections commonly known as double wide mobile home sections. Where a drop floor as described above is installed within a double wide mobile home section, an open sided drop floor slot is utilized in place of the drop floor aperture of the main floor of a single wide mobile home, the drop floor slot being surrounded by a drop floor slot frame just as, referring to FIG. 1, steel cross beams 62 and 64 in combination with 'I' beams 14 provide a frame for the drop floor aperture of the single wide mobile home 1. Upon joinder of a pair of double wide mobile home sections to form a single double wide residential structure, the open sides of its paired drop floor slots face and align with each other, forming a single large drop floor aperture which underlies paired lower split level room sections, and which underlies paired upper split level room sections.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A road transportable home comprising:

(a) a main floor having a drop floor aperture therethrough;

(b) a drop living space floor, the drop living space floor comprising a frame, a plurality of floor joists spanning across the frame, and decking overlying the floor joists, the drop living space floor being fitted so that it may underlie the drop floor aperture; and (c) drop floor mounting means capable of movably attaching the drop floor to the floor so that the drop living space floor may travel between a first position and a second position, the first position having an elevation below that of the main floor, the second position having an elevation above that of the first position, the drop floor mounting means interconnecting the drop living space floor and the floor.

2. The road transportable home of claim 1, further comprising a plurality of walls fixedly attached to and extending upwardly from the main floor, and an upper floor fixedly attached to at least two of the walls and positioned thereon so that the upper floor overlies the drop floor aperture, the upper floor having an elevation above the elevation of the main floor.

3. The road transportable home of claim 2, further comprising a stair fixedly attached to an extending upwardly from the drop living space floor, the stair being positioned to provide access to the drop living space floor from the main floor while the drop living space floor is at its first position.

4. The road transportable home of claim 2, further comprising a stair fixedly attached to and extending downwardly from the main floor, the stair being positioned to provide access to the drop living she floor from the main floor while the drop living space floor is at its first position.

5. The road transportable home of claim 3, further comprising a lower split level room and an upper split level room, each split level room having a floor, the floor of the lower split level room comprising the drop living space floor, the floor of the upper split level room comprising the upper floor.

6. The road transportable home of claim 4, further comprising a lower split level room and an upper split level room, each split level room having a floor, the floor of the lower split level room comprising the drop living space floor, the floor of the upper split level room comprising the upper floor.

7. The road transportable home of claim 5, wherein the drop floor mounting means comprises a drop floor aperture frame and a plurality of slide joints, the drop floor aperture frame being fixedly attached to the main floor and the slide joints slidably interconnecting the drop floor aperture frame and the drop floor frame.

8. The road transportable home of claim 6, wherein the drop floor mounting means comprises a drop floor aperture frame and a plurality of slide joints, the drop floor aperture frame being fixedly attached to the main floor and the slide joints slidably interconnecting the drop floor aperture frame and the drop floor frame.

9. The road transportable home of claim 7, wherein the slide joints comprise a plurality of slide shafts fixedly attached to and extending upwardly from the drop floor frame.

10. The road transportable home of claim 8, wherein the slide joints comprise a plurality of slide shafts fixedly attached to and extending upwardly from the drop floor frame.

11. A road transportable double wide home section comprising:

(a) a main floor having a drop floor slot therethrough;

(b) a drop living space floor, the drop living space floor comprising a frame, a plurality of floor joists spanning across the frame, and decking overlying the floor joists, the drop living space floor being fitted so that it may underlie the drop floor slot; and (c) drop floor mounting means capable of movably attaching the drop living space floor to the main floor so that the drop living space floor may travel between a first position and a second position, the first position having an elevation below that of the main floor, the second position having an elevation above that of the first position, the drop living space floor mounting means interconnecting the drop living space floor and the main floor.

12. The road transportable double wide home section of claim 11, further comprising a plurality of walls fixedly attached to and extending upwardly from the main floor, and an upper floor fixedly attached to at least two of the walls and positioned thereon so that the upper floor overlies the drop floor slot, the upper floor having an elevation above the elevation of the main floor.

13. The road transportable double wide home section of claim 12, further comprising a stair fixedly attached to and extending upwardly from the drop living space floor, the stair being positioned to provide access to the drop living space floor from the main floor while the drop living space floor is at its first position.

14. The road transportable double wide home section of claim 12, further comprising a stair fixedly attached to and extending downwardly from the main floor, the stair being positioned to provide access to the drop living space floor from the floor while the drop living space floor is at its first position.

15. The road transportable double wide home section of claim 13, further comprising a lower split level room section and a split level room section, each split level room section having a split level room floor, the split level room floor of the lower split level room section comprising the drop living space floor, the split level room floor of the upper split level room section comprising the upper floor.

16. The road transportable double wide home section of claim 14, further comprising a lower split level room section and an upper split level room section, each split level room section having a split level floor, the split level floor of the lower split level room section comprising the drop living space floor, the split level room floor of the upper split level room section comprising the upper floor.

17. The road transportable double wide home section of claim 15, wherein the drop floor mounting means comprises a drop floor slot frame and a plurality of slide joints, the drop floor slot frame being fixedly attached to the main floor and the slide joints slidably interconnecting the drop floor slot frame and the drop floor frame.

18. The road transportable double wide home section of claim 16, wherein the drop floor mounting means comprises a drop floor slot frame and a plurality of slide joints, the drop floor slot frame being fixedly attached to the main floor and the slide joints slidably interconnecting the drop floor slot frame with the drop floor frame.

19. The road transportable double wide home section of claim 17, wherein the slide joints comprise a plurality of slide shafts fixedly attached to and extending upwardly from the drop floor frame.

20. The road transportable double wide home section of claim 18, wherein the slide joints comprise a plurality of slide shafts fixedly attached to and extending upwardly from the drop floor frame.

* * * * *